US011840911B2

(12) United States Patent
Fan et al.

(10) Patent No.: US 11,840,911 B2
(45) Date of Patent: Dec. 12, 2023

(54) FRACTURING METHOD WITH SYNERGISTIC EFFECTS OF ENERGY ENHANCEMENT, OIL DISPLACEMENT, HUFF AND PUFF, IMBIBITION, AND DISPLACEMENT

(71) Applicant: Nanniwan Oil Production Plant, Yanchang Oilfield Co., Ltd., Yan'an (CN)

(72) Inventors: Pingtian Fan, Yan'an (CN); Weichu Yu, Yan'an (CN); Yuetian Liu, Yan'an (CN); Ping Li, Yan'an (CN); Yongdong Wang, Yan'an (CN); Baolin Guan, Yan'an (CN); Fengping Yan, Yan'an (CN); Yongtao Song, Yan'an (CN); Wenming Shu, Yan'an (CN); Aibin Wu, Yan'an (CN); Min Sun, Yan'an (CN)

(73) Assignee: Nanniwan Oil Production Plant, Yanchang Oilfield Co., Ltd., Yan'an (CN)

( * ) Notice: Subject to any disclaimer, the term of this patent is extended or adjusted under 35 U.S.C. 154(b) by 0 days.

(21) Appl. No.: 17/939,711

(22) Filed: Sep. 7, 2022

(65) Prior Publication Data

US 2023/0193732 A1 Jun. 22, 2023

(30) Foreign Application Priority Data

Dec. 21, 2021 (CN) ..... 202111569454.7

(51) Int. Cl.
*E21B 43/26* (2006.01)
*E21B 43/267* (2006.01)

(52) U.S. Cl.
CPC ..... *E21B 43/26* (2013.01)

(58) Field of Classification Search
None
See application file for complete search history.

(56) References Cited

U.S. PATENT DOCUMENTS 4,353,244 A * 10/1982 Wood ..... G01H 9/00 33/1 H
7,426,961 B2 * 9/2008 Stephenson ..... E21B 43/267 166/308.2

(Continued)

*Primary Examiner* — Matthew R Buck
*Assistant Examiner* — Douglas S Wood
(74) *Attorney, Agent, or Firm* — Zhigang Ma

(57) ABSTRACT

Disclosed is a fracturing method with synergistic effects of energy enhancement, oil displacement, huff and puff, imbibition, and displacement, comprising the following steps: selecting a well that has never been fracted as a fracturing well; dividing the target layer into several fracturing intervals; performing perforating operations on each fracturing interval of the fracturing well; injecting pore cleaning fluid into the fracturing well to perform pore cleaning and acidizing pretreatment on each cluster perforation; designing fracturing construction parameters; alternately injecting slick water fracturing fluid and oil-displacement slick water fracturing fluid into each of the fracturing layers. The beneficial effects of this disclosure are: the construction method of slick water fracturing fluid with high pump rate and large displacement can form a more complex fracture network structure, tap the production potential of the target reservoir, and further improve the stimulation effect of the reservoir.

7 Claims, 2 Drawing Sheets

(56) References Cited

U.S. PATENT DOCUMENTS

| | | | | |
|---|---|---|---|---|
| 2003/0173082 | A1* | 9/2003 | Vinegar | E21B 43/243 166/272.2 |
| 2008/0087429 | A1* | 4/2008 | Brannon | E21B 43/267 166/280.1 |
| 2009/0145606 | A1* | 6/2009 | Hocking | E21B 43/26 166/62 |
| 2013/0333892 | A1* | 12/2013 | McClung, IV | E21B 43/27 166/308.3 |
| 2016/0153273 | A1* | 6/2016 | Nguyen | C09K 8/5758 166/243 |
| 2017/0107796 | A1* | 4/2017 | Karale | E21B 43/25 |
| 2018/0238160 | A1* | 8/2018 | Nguyen | E21B 43/267 |
| 2019/0309216 | A1* | 10/2019 | Jin | E21B 43/26 |

* cited by examiner

FRACTURING METHOD WITH SYNERGISTIC EFFECTS OF ENERGY ENHANCEMENT, OIL DISPLACEMENT, HUFF AND PUFF, IMBIBITION, AND DISPLACEMENT

FIELD OF THE DISCLOSURE

The disclosure relates to the technical field of fracturing, in particular to a fracturing method with synergistic effects of energy enhancement, oil displacement, huff and puff, imbibition, and displacement.

BACKGROUND

Tight oil and gas reservoirs are known as the most promising and realistic oil and gas exploration and development fields in the 21st century, and are also an important strategic successor to ensure China's energy security. China's new round of oil and gas resources evaluation shows that tight oil accounts for about ⅔ of all recoverable oil resources, accounting for nearly half, with huge potential. Therefore, the use of reasonable and effective hydraulic fracturing operations is of great significance to the commercial development of tight oil and gas reservoirs in China.

In the existing tight oil reservoir exploitation practice, high-viscosity fracturing fluid is mainly used for reservoir stimulation, and the high viscosity of the system is used to achieve the purpose of reducing filtration loss, suppressing pressure, and creating fractures, and carrying sand. The stimulation effect is obtained by connecting artificial fractures with natural fractures to form seepage channels. However, high-viscosity fracturing fluid has high viscosity, large molecular beam diameter, and large flow resistance in the formation, making it extremely difficult to enter small pores and matrices. Therefore, the effect of high-viscosity fracturing fluid system in the stimulation of medium and low permeability reservoirs has the problems of rapid production decline and low recovery rate when used in the exploitation of tight oil reservoirs.

SUMMARY

The purpose of this disclosure is to provide a fracturing method with synergistic effects of energy enhancement, oil displacement, huff and puff, imbibition, and displacement to solve the technical problem of rapid production decline caused by the use of high-viscosity fracturing fluid during the exploitation of tight oil reservoirs.

This disclosure provides a fracturing method with synergistic effects of energy enhancement, oil displacement, huff and puff, imbibition, and displacement, comprising the following steps:

S1, selecting a well that has never been fracted as a fracturing well, obtaining reservoir parameters of the target layer of the fracturing well, and judging the compressibility of the reservoir according to the reservoir parameters;

S2, after determining that the reservoir can be compressible, dividing the target layer into several fracturing intervals;

S3, performing perforating operations on each fracturing interval of the fracturing well, so as to form cluster perforation in each fracturing interval;

S4, injecting pore cleaning fluid into the fracturing well to perform pore cleaning and acidizing pretreatment on each cluster perforation;

S5, designing fracturing construction parameters, wherein the fracturing construction parameters include at least pump rate, and the pump rate is higher than 10 m3/min;

S6, according to the fracturing construction parameters, alternately injecting slick water fracturing fluid and oil-displacement slick water fracturing fluid into each of the fracturing layers, respectively, wherein the oil-displacement slick water fracturing fluid is a slick water fracturing fluid added with an oil-displacement agent; at the same time, proppant is added intermittently between the slick water fracturing fluid and the oil-displacement slick water fracturing fluid, and particle size of the added proppant gradually increases, and the sand ratio of the fracturing fluid gradually increases, so as to realize fracture formation and sand filling;

S7, after completion of the sand filling, injecting a displacement fluid into each of the fracturing intervals to inject the sand-carrying fluid in the wellbore into the fractures;

S8, soaking the well for a period of time, then opening the well for production.

Compared with the prior art, the beneficial effects of the technical solution proposed by this disclosure are as follows:

(1) Adding small-sized proppant first and then adding large-sized proppant, since the small-sized proppant is not easy to settle and migrates farther, it can fill the micro-fractures in the far-well zone of the fracturing well, and support the micro-fractures in the far-end reservoir of the fracturing well. Afterwards, large-sized proppant is added, which is easy to settle and has a short migration distance, so that the main fracture can be opened in the near-wellbore zone of the fracturing well, and the main fracture can be supported. Therefore, the propping effect and influence range of the proppant can be increased, thereby increasing the sweeping efficiency of the biological oil displacement agent, and at the same time preventing the occurrence of sand plugging.

(2) The construction method of slick water fracturing fluid with large fluid volume and high pump rate can form a more complex fracture network, tap the production potential of the target reservoir, and further improve the stimulation effect of the reservoir.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
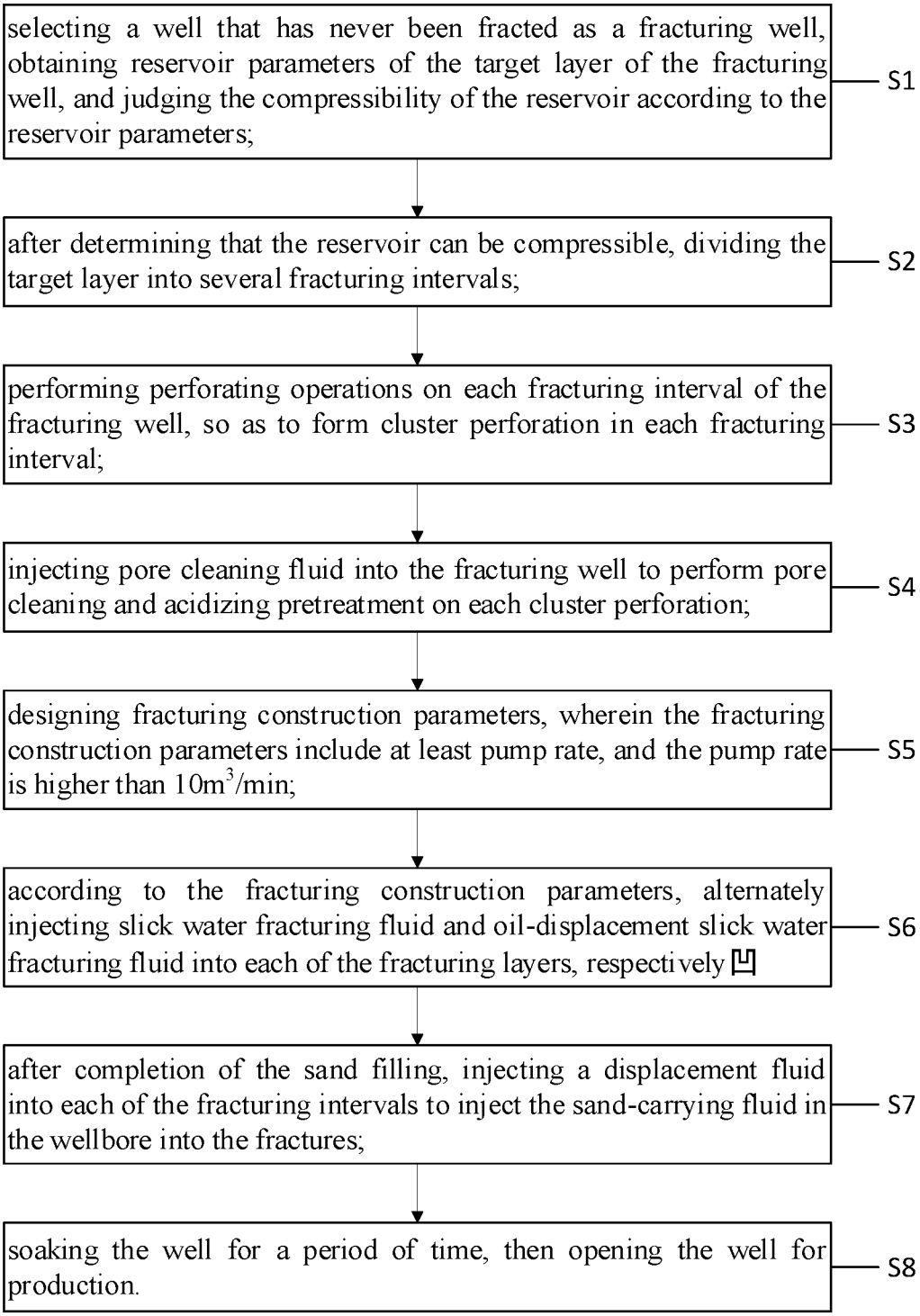
FIG. 1 is a schematic flowchart of an embodiment of the fracturing method with synergistic effects of energy enhancement, oil displacement, huff and puff, imbibition, and displacement provided by this disclosure.

As shown in FIG. 1, this disclosure provides a fracturing method with synergistic effects of energy enhancement, oil displacement, huff and puff, imbibition, and displacement, comprising the following steps:

S1, selecting a well that has never been fracted as a fracturing well, obtaining reservoir parameters of the target layer of the fracturing well, and judging the compressibility of the reservoir according to the reservoir parameters;

In this embodiment, a horizontal well in the Nanniwan Oil Production Plant of Yanchang Oilfield that has never been fracted is selected as the fracturing well. There are many reservoirs in this area, mainly shallow tight oil reservoirs, which are characterized by complex geological conditions, tight reservoirs, and complex pore-throat structures. Oil wells developed by conventional methods have short stable production time, rapid decline, and low production, making it difficult to stabilize oil production.

Determining the compressibility of a reservoir is the prior art, and will not be discussed here.

Figure 2:
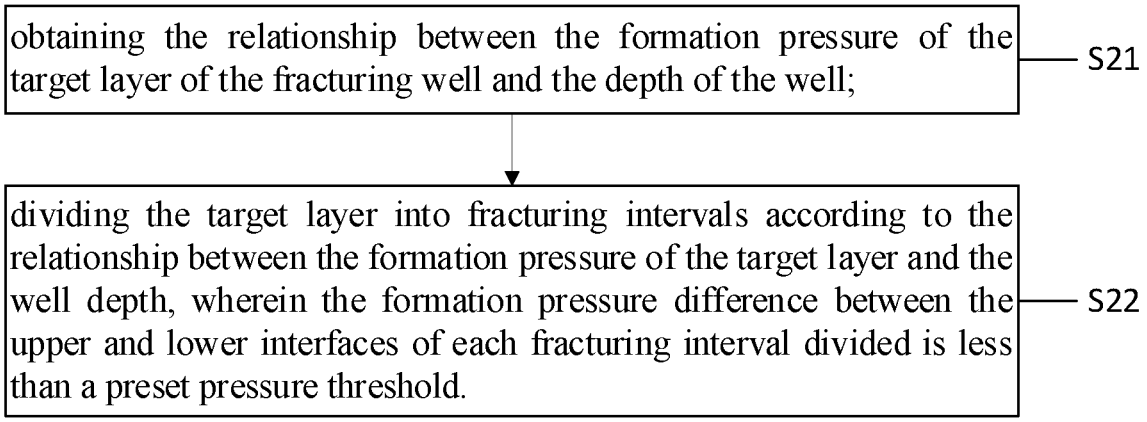
FIG. 2 is the schematic flow sheet of step S2 in FIG. 1.

S2, after determining that the reservoir can be compressible, dividing the target layer into several fracturing intervals;

Please refer to FIG. 2, the specific method for dividing the target layer into fracturing intervals comprises:

S21, obtaining the relationship between the formation pressure of the target layer of the fracturing well and the depth of the well;

S22, dividing the target layer into fracturing intervals according to the relationship between the formation pressure of the target layer and the well depth, wherein the formation pressure difference between the upper and lower interfaces of each fracturing interval divided is less than a preset pressure threshold.

In this embodiment, there are 8 fracturing intervals in the horizontal well. It should be understood that, in other embodiments, the number of fracturing intervals may be different, which is not limited by this disclosure.

S3, performing perforating operations on each fracturing interval of the fracturing well, so as to form cluster perforation in each fracturing interval;

In step S3, the method of perforating operation comprises at least one of oil pipe transmission perforation and cable perforation.

In this embodiment, the first fracturing interval is perforated by oil pipe transmission perforation, and the subsequent 7 fracturing intervals are perforated by cable perforation. Each section of perforation has 4 clusters, the number of the perforation holes is 40, the perforation length of each cluster is 1 m, and the perforation density is 10 holes/m.

Perforation location selection principles include: (1) the minimum principal stress corresponding to multiple perforation clusters in each section should be basically the same; (2) each perforation cluster at each level corresponds to a position with relatively good physical properties, or a position where the physical properties of each perforation cluster at each level are basically the same.

S4, injecting pore cleaning fluid into the fracturing well to perform pore cleaning and acidizing pretreatment on each cluster perforation;

In step S4, composition of the pore cleaning fluid is: 3% of hydrofluoric acid, 12% of hydrogen chloride, 0.5% of drainage aid, 0.3% of corrosion inhibitor, and 84.2% of water.

In this embodiment, the injection displacement of the pore cleaning fluid is 2 $m^3$/min, and the injection volume is 20 $m^3$ each time.

S5, designing fracturing construction parameters, wherein the fracturing construction parameters include at least pump rate, and the pump rate is higher than 10 $m^3$/min (not less than 0.25 $m^3$/min for each hole), so as to have a larger pump rate than conventional fracturing construction, thereby providing an energy basis for the formation of volumetric fractures in the reservoir.

The fracturing construction parameters also include working pressure, and the working pressure is not greater than 55 MPa, so as to ensure the safety of the fracturing construction process.

The fracturing construction parameters also include the volume of the fracturing fluid, and the single-stage volume of the fracturing fluid is greater than 1000 $m^3$. The method for determining the volume of the fracturing fluid is as follows: according to the evaluation results of the target reservoir, simulating and calculating the total volume of fractures in the fracturing interval with a reasonable half-fracture length, and then obtaining the volume of fracturing fluid.

S6, according to the fracturing construction parameters, alternately injecting slick water fracturing fluid and oil-displacement slick water fracturing fluid into each of the fracturing layers, respectively, wherein the oil-displacement slick water fracturing fluid is a slick water fracturing fluid added with an oil-displacement agent; at the same time, proppant is added intermittently between the slick water fracturing fluid and the oil-displacement slick water fracturing fluid, and particle size of the added proppant gradually increases, and the sand ratio of the fracturing fluid gradually increases, so as to realize fracture formation and sand filling; Slick water fracturing fluid has low viscosity and little damage to the reservoir.

In step S6, composition of the slick water fracturing fluid is: 0.1% of drag reducing agent, 0.2% of multifunctional additive, 0.05% of bactericide and 99.45% of water. The oil-displacement slick water fracturing fluid is slick water containing 0.5% of biological oil-displacement agent.

In step S6, the added proppants are respectively: 40/70 mesh quartz sand, 30/50 mesh quartz sand, and 20/40 mesh quartz sand (the larger the mesh, the smaller the particle size) according to the order of addition.

In this embodiment, the pumping procedure of a certain segment is shown in Table 1 below:

TABLE 1

Pumping procedure of a fracturing interval on site

| Construction stage | Casing injection Liquid type | Volume ($m^3$) | Pump rate ($m^3$/min) | Sand ratio (%) | Mesh of proppant |
|---|---|---|---|---|---|
| filling wellbore pre-liquid | slick water | 45 | 0.1~2 | 0 | none |
| | oil-displacement slick water | 10 | 2~4 | 0 | none |
| | | 15 | 4~6 | 0 | none |
| | | 20 | 6--12 | 0 | none |
| | | 25 | 12 | 0 | none |
| | | 40 | 12 | 2 | 40/70 |
| | slick water | 45 | 12 | 0 | none |
| | | 34 | 12 | 5 | 40/70 |
| | | 45 | 12 | 0 | none |
| | | 33 | 12 | 6 | 40/70 |
| | | 45 | 12 | 0 | none |
| | | 34 | 12 | 7 | 40/70 |
| | | 45 | 12 | 0 | none |
| | | 31 | 12 | 8 | 40/70 |
| | | 45 | 12 | 0 | none |
| | | 32 | 12 | 9 | 40/70 |
| | | 65 | 12 | 0 | none |
| sand-carrying fluid | slick water | 23 | 12 | 8 | 40/70 |
| | | 18 | 12 | 9 | 40/70 |
| | | 14 | 12 | 10 | 40/70 |
| | oil-displacement slick water | 45 | 12 | 0 | none |
| | | 7 | 12 | 9 | 40/70 |
| | | 7 | 12 | 10 | 40/70 |
| | | 7 | 12 | 11 | 40/70 |
| | | 45 | 12 | 0 | none |

TABLE 1-continued

| Pumping procedure of a fracturing interval on site | | | | | |
|---|---|---|---|---|---|
| Construction stage | Casing injection Liquid type | Volume ($m^3$) | Pump rate ($m^3$/min) | Sand ratio (%) | Mesh of proppant |
| | slick water | 18 | 12 | 10 | 30/50 |
| | | 15 | 12 | 11 | 30/50 |
| | | 9 | 12 | 12 | 30/50 |
| | | 7 | 12 | 13 | 30/50 |
| | | 45 | 12 | 0 | none |
| | | 18 | 12 | 8 | 30/50 |
| | | 14 | 12 | 9 | 30/50 |
| | | 11 | 12 | 10 | 30/50 |
| | | 15 | 12 | 12 | 30/50 |
| | | 45 | 12 | 0 | none |
| | | 16 | 12 | 9 | 30/50 |
| | | 13 | 12 | 10 | 30/50 |
| | | 17 | 12 | 11 | 30/50 |
| | | 15 | 12 | 13 | 30/50 |
| | | 45 | 12 | 0 | none |
| | | 16 | 12 | 10 | 30/50 |
| | | 13 | 12 | 11 | 30/50 |
| | | 9 | 12 | 12 | 30/50 |
| | | 6 | 12 | 14 | 30/50 |
| | | 45 | 12 | 0 | none |
| | | 16 | 12 | 11 | 30/50 |
| | | 13 | 12 | 12 | 30/50 |
| | | 9 | 12 | 13 | 30/50 |
| | | 6 | 12 | 15 | 30/50 |
| | | 45 | 12 | 0 | none |
| | | 16 | 12 | 13 | 30/50 |
| | | 13 | 12 | 14 | 30/50 |
| | | 9 | 12 | 15 | 30/50 |
| | | 6 | 12 | 15 | 30/50 |
| | | 45 | 12 | 0 | none |
| | | 17 | 12 | 10 | 20/40 |
| | | 14 | 12 | 11 | 20/40 |
| | | 8 | 12 | 12 | 20/40 |
| | | 5 | 12 | 13 | 20/40 |
| | oil-displacement | 45 | 12 | 0 | none |
| | | 15 | 12 | 11 | 20/40 |
| | slick water | 13 | 12 | 12 | 20/40 |
| | | 12 | 12 | 13 | 20/40 |
| | | 9 | 12 | 14 | 20/40 |
| | | 7 | 12 | 15 | 20/40 |
| | | 6 | 12 | 15 | 20/40 |
| displacement fluid | slick water | 30 | 12 | 0 | none |
| Total | | 1516 | | | |

By adopting this method of intermittently adding biological oil-displacement agent and quartz sand with different particle sizes, it is possible to avoid a large amount of biological oil-displacement agent and quartz sand with small particle size entering into the main fractures due to the fact that the extension resistance of main fractures is much lower than that of branch fractures, thus increasing the sweeping efficiency of the biological oil-displacement agent and the sand-filling effect of the proppant. Specifically, the proppant with small particle size is added first, because the proppant with small particle size is not easy to settle, and the migration distance is longer. Therefore, it can be filled into the micro-fractures in the far-well zone of the fracturing well, and support the micro-fractures in the far-end reservoir of the fracturing well. Afterwards, large-sized proppant is added, which is easy to settle and has a short migration distance, so that the main fractures can be opened in the near-wellbore zone of the fracturing well, and the main fractures can be supported. Therefore, the method of adding small-size proppant first and then adding large-size proppant can increase the propping effect and influence range of the proppant, thereby increasing the sweeping efficiency of the biological oil-displacement agent. What is more, intermittent addition of supports can also prevent sand plugging.

The biological oil-displacement agent can play the role of displacement, reducing the interfacial tension, and reducing the viscosity of crude oil. Moreover, the purpose of selecting a well that has never been fracted as a fracturing well is to avoid the water lock effect of the reservoir, thereby improving the oil-displacement effect of the biological oil-displacement agent. Specifically, the fracturing well has never been fracturing before, so there will be no residual fracturing fluid in the reservoir due to the previous fracturing. Therefore, the influence of the water lock effect on the subsequent biological oil-displacement agent can be avoided, and the oil recovery rate can be improved.

In order to solve the problem that the proppant settles prematurely and blocks the pore throat due to insufficient viscosity sand-carrying ability during the sand-carrying process of low-viscosity slick water fracturing fluid, the method of high pump rate, high displacement, low sand ratio, pulse progressive sand addition, and impulse sand carrying is adopted. It effectively guarantees the hierarchical filling and support of micro-fractures, branch fractures and main fractures, which is conducive to the formation of continuous and effective seepage channels.

At the same time, this fracturing method with high pump rate and large displacement of slick water can form a more complex fracture network, tap the production potential of the target reservoir, and further improve the reservoir stimulation effect. Under the dual action of high pump rate and large flow rate, it can fully enter the micro-channel and reservoir matrix with extremely low energy loss. Under high pump rate and high flow rate, hydraulic flushing similar to water jet cutting is formed on the channel, and the excess liquid volume and energy are used to break the formation, so the reservoir stimulation (SRV) is more sufficient and efficient. At the same time, a large amount of fracturing fluid enters the target reservoir, effectively increasing the formation energy.

S7, after completion of the sand filling, injecting a displacement fluid into each of the fracturing intervals to inject the sand-carrying fluid in the wellbore into the fractures. In this embodiment, the displacement fluid is a slick water fracturing fluid.

S8, soaking the well for a period of time, then opening the well for production.

In this embodiment, the time for soaking the well is 10 to 15 days. During the soaking period, the fracturing fluid with low surface tension and low interfacial tension will further enter the micro-channels under the dual action of pressure driving and capillary force imbibition, which will increase the degree of swept up. The biological oil-displacement agent contained in the fracturing fluid can effectively reduce the viscosity of crude oil, improve the fluidity of oil and water, avoid the wetting reversal of the reservoir rock mass, and improve the efficiency of oil washing and oil-displacement. Due to fracturing and energy diffusion, the pressure in the far-well area is gradually increased. After the well is soaked and the well is opened for production, the fracturing fluid in the near-well area will be released with the opening of the well, forming a pressure relief area, and the fracturing fluid in the far-well area will flow back to the near-well area driven by the pressure difference. In this process, a compound effect of "huff and puff+displacement" occurs. Therefore, the fracturing method provided by this disclosure combines fracturing with huff and puff, imbibition, and displacement synergistically for the first time, and the biological oil-displacement agent is added to the fracturing fluid to synergistically produce the comprehensive performance of the oil-displacement agent for tertiary oil recovery and improve the recovery rate of the original reservoir.

In this embodiment, other wells in this area have used conventional fracturing technology previously, and the fracturing effect is poor, which was manifested as low initial production after conventional fracturing, small cumulative production increase, and poor economic benefits. After fracturing the well with the synergistic fracturing method of "energy enhancement-oil-displacement-huff and puff-imbibition-displacement" of this disclosure, the initial output is 12-18 tons/day. After one year, the output will decrease by 30%, and the recovery degree will increase by 6%. The average daily liquid production and daily oil production are significantly higher than those of wells fracturing with conventional technology.

In conclusion, the beneficial effects of the technical solution provided by this disclosure are as follows:

The method of adding small particle size proppant first and then adding large particle size proppant is used. Since the small-sized proppant is not easy to settle and migrates farther, it can fill the micro-fractures in the far-well zone of the fracturing well, and support the micro-fractures in the far-end reservoir of the fracturing well. Afterwards, large-sized proppant is added, which is easy to settle and has a short migration distance, so that the main fracture can be opened in the near-wellbore zone of the fracturing well, and the main fracture can be supported. Therefore, the propping effect and the influence range of the proppant can be increased, thereby increasing the sweeping efficiency of the biological oil-displacement agent, and at the same time preventing the occurrence of sand plugging.

(2) The construction method of slick water fracturing fluid with high pump rate and large displacement can form a more complex fracture network structure, tap the production potential of the target reservoir, and further improve the stimulation effect of the reservoir.

It is to be understood, however, that even though numerous characteristics and advantages of this disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fracturing method with synergistic effects of energy enhancement, oil displacement, huff and puff, imbibition, and displacement, comprising the following steps:

S1, selecting a well that has never been fracted as a fracturing well, obtaining reservoir parameters of the target layer of the fracturing well, and judging the compressibility of the reservoir according to the reservoir parameters;

S2, after determining that the reservoir can be compressible, dividing the target layer into several fracturing intervals;

S3, performing perforating operations on each fracturing interval of the fracturing well, so as to form cluster perforation in each fracturing interval;

S4, injecting pore cleaning fluid into the fracturing well to perform pore cleaning and acidizing pretreatment on each cluster perforation;

S5, designing fracturing construction parameters, wherein the fracturing construction parameters include at least pump rate, and the pump rate is higher than 10 m3/min;

S6, according to the fracturing construction parameters, alternately injecting slick water fracturing fluid and oil-displacement slick water fracturing fluid into each of the fracturing layers, respectively, wherein the oil-displacement slick water fracturing fluid is a slick water fracturing fluid added with an oil-displacement agent; at the same time, proppant is added intermittently between the slick water fracturing fluid and the oil-displacement slick water fracturing fluid, and particle size of the added proppant gradually increases, and the sand ratio of the fracturing fluid gradually increases, so as to realize fracture formation and sand filling;

wherein composition of the slick water fracturing fluid is: 0.1% of drag reducing agent, 0.2% of multifunctional additive, 0.05% of bactericide and 99.45% of water;

the oil-displacement slick water fracturing fluid is slick water containing 0.5% of biological oil-displacement agent;

the added proppants are respectively: 40/70 mesh quartz sand, 30/50 mesh quartz sand, and 20/40 mesh quartz sand according to the order of addition; and the sand ratio of the fracturing fluid does not exceed 15%;

S7, after completion of the sand filling, injecting a displacement fluid into each of the fracturing intervals to inject the sand-carrying fluid in the wellbore into the fractures;

S8, soaking the well for a period of time, then opening the well for production.

2. The fracturing method with synergistic effects of energy enhancement, oil displacement, huff and puff, imbibition, and displacement according to claim 1, in step S2, the specific method for dividing the target layer into fracturing intervals comprises:

S21, obtaining the relationship between the formation pressure of the target layer of the fracturing well and the depth of the well;

S22, dividing the target layer into fracturing intervals according to the relationship between the formation pressure of the target layer and the well depth, wherein the formation pressure difference between the upper and lower interfaces of each fracturing interval divided is less than a preset pressure threshold.

3. The fracturing method with synergistic effects of energy enhancement, oil displacement, huff and puff, imbibition, and displacement according to claim 1, in step S3, the method of perforating operation comprises at least one of oil pipe transmission perforation and cable perforation.

4. The fracturing method with synergistic effects of energy enhancement, oil displacement, huff and puff, imbibition, and displacement according to claim 1, in step S4, composition of the pore cleaning fluid is: 3% of hydrofluoric acid, 12% of hydrogen chloride, 0.5% of drainage aid, 0.3% of corrosion inhibitor, and 84.2% of water.

5. The fracturing method with synergistic effects of energy enhancement, oil displacement, huff and puff, imbibition, and displacement according to claim 1, in step S5, the fracturing construction parameters comprise working pressure, and the working pressure is not greater than 55 MPa.

6. The fracturing method with synergistic effects of energy enhancement, oil displacement, huff and puff, imbibition, and displacement according to claim 1, in step S5, the soaking time is 10-15 days.

7. The fracturing method with synergistic effects of energy enhancement, oil displacement, huff and puff, imbibition, and displacement according to claim 5, in step S5, the fracturing construction parameters further comprise volume of the fracturing fluid, and the single-stage volume of the fracturing fluid is greater than 1000 $m^3$.

* * * * *